US009878223B2

(12) United States Patent
Foster et al.

(10) Patent No.: US 9,878,223 B2
(45) Date of Patent: Jan. 30, 2018

(54) GOLF CLUB HEAD WITH ADJUSTABLE CENTER OF GRAVITY

(71) Applicant: Callaway Golf Company, Carlsbad, CA (US)

(72) Inventors: Philip G. Foster, Vista, CA (US); Matthew Myers, Carlsbad, CA (US); Wee Joung Kim, Vista, CA (US); Steven C. Sutton, Carlsbad, CA (US); Larry Tang, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/446,891

(22) Filed: Mar. 1, 2017

(65) Prior Publication Data

US 2017/0173422 A1 Jun. 22, 2017

Related U.S. Application Data

(60) Division of application No. 14/932,171, filed on Nov. 4, 2015, now Pat. No. 9,630,069, which is a (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/0466* (2013.01); *A63B 60/04* (2015.10);
(Continued)

(58) Field of Classification Search
USPC ..... 473/324–350
See application file for complete search history.

(56) References Cited

U.S. PATENT DOCUMENTS 2,198,981 A * 4/1940 Sullivan ..... A63B 53/08 473/338
3,652,094 A * 3/1972 Glover ..... A63B 53/08 473/337
(Continued)

FOREIGN PATENT DOCUMENTS

JP 01043278 A * 2/1989
JP 2005296582 A * 10/2005
(Continued)

*Primary Examiner* — Alvin Hunter
(74) *Attorney, Agent, or Firm* — Rebecca Hanovice; Michael Catania; Sonia Lari

(57) ABSTRACT

A golf club head comprising multiple means of adjusting the location of the center of gravity, and the bias, is disclosed herein. In a preferred embodiment, the golf club head comprises a non-metal medallion comprising a channel that is affixed to one of the crown and the sole, a slidable weight sized to fit within the channel, and a cover that attaches to the medallion and locks the slidable weight within the channel at a location selected by a user. The cover preferably includes at least one cutout so that the slidable weight is at least partially visible to the user when it is locked within the channel. The cover also includes additional cutouts that receive protrusions extending from the medallion to more securely attach the cover to the medallion.

17 Claims, 9 Drawing Sheets

Related U.S. Application Data continuation of application No. 14/163,946, filed on Jan. 24, 2014, now Pat. No. 9,211,453, and a continuation-in-part of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506, said application No. 14/163,946 is a continuation-in-part of application No. 13/766,658, filed on Feb. 13, 2013, now Pat. No. 8,790,195.

(60) Provisional application No. 61/893,728, filed on Oct. 21, 2013, provisional application No. 61/727,608, filed on Nov. 16, 2012, provisional application No. 61/746,348, filed on Dec. 27, 2012.

(51) Int. Cl.
*A63B 60/04* (2015.01)
*A63B 60/52* (2015.01)

(52) U.S. Cl.
CPC ..... *A63B 60/52* (2015.10); *A63B 2053/0433* (2013.01); *A63B 2053/0495* (2013.01)

(56) References Cited

U.S. PATENT DOCUMENTS 6,015,354 A * 1/2000 Ahn ..... A63B 53/04 473/256
6,409,612 B1 * 6/2002 Evans ..... A63B 53/04 473/324
6,592,468 B2 * 7/2003 Vincent ..... A63B 53/047 473/334
6,648,772 B2 * 11/2003 Vincent ..... A63B 53/04 473/334
6,663,505 B1 * 12/2003 Solari ..... A63B 53/0487 473/334
6,811,496 B2 * 11/2004 Wahl ..... A63B 53/047 473/334
6,902,495 B2 * 6/2005 Pergande ..... A63B 53/047 473/329
7,108,609 B2 * 9/2006 Stites ..... A63B 53/06 473/256
7,452,286 B2 * 11/2008 Lin ..... A63B 53/0466 473/334
7,611,424 B2 * 11/2009 Nagai ..... A63B 53/0466 473/334
8,016,694 B2 * 9/2011 Llewellyn ..... A63B 53/0466 473/334
8,870,678 B2 * 10/2014 Beach ..... A63B 53/0466 473/334
9,211,453 B1 * 12/2015 Foster ..... A63B 53/06
2006/0172821 A1 * 8/2006 Evans ..... A63B 53/0466 473/349
2006/0240908 A1 * 10/2006 Adams ..... A63B 53/0466 473/334
2008/0261715 A1 * 10/2008 Carter ..... A63B 53/0466 473/291

FOREIGN PATENT DOCUMENTS

JP 2005323978 A * 11/2005
JP 2006320493 A * 11/2006
JP 2010252964 A * 11/2010
JP 2011005167 A * 1/2011 ..... A63B 53/0466
JP 2011010722 A * 1/2011
JP 2011229914 A * 11/2011
WO WO 2007044220 A1 * 4/2007 ..... A63B 53/06

* cited by examiner

GOLF CLUB HEAD WITH ADJUSTABLE CENTER OF GRAVITY

CROSS REFERENCES TO RELATED APPLICATIONS

The present application is a division of U.S. patent application Ser. No. 14/932,171, filed on Nov. 4, 2015, which is a continuation of U.S. patent application Ser. No. 14/163,946, filed on Jan. 24, 2014, and issued on Dec. 15, 2015, as U.S. Pat. No. 9,211,453, which claims priority to U.S. Provisional Patent Application No. 61/893,728, filed on Oct. 21, 2013, and is a continuation-in-part of U.S. patent application Ser. No. 14/033,218, filed on Sep. 20, 2013, and issued on Apr. 15, 2015, as U.S. Pat. No. 8,696,491, which is a continuation-in-part of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein. U.S. patent application Ser. No. 14/163,946 also is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along one or more channels.

Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within one or more channels disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a crown, a sole, a hosel, a heel side, a toe side, a face, a rear side opposite the face, an edge portion where the crown connects with the sole, and a channel, wherein the channel extends from the sole to the crown via the rear side.

Another aspect of the present invention is a golf club comprising a body comprising a crown, a sole, a hosel, a heel side, a toe side, a face, a rear side opposite the face, an edge portion where the crown connects with the sole, and a channel, a cartridge sized to fit within the channel, the cartridge comprising an opening, and a weight sized to fit within the opening. In some embodiments, the opening in the cartridge may be elongated, and the weight may be capable of sliding within the elongated opening.

Yet another aspect of the present invention is a golf club head comprising a crown, a sole, a hosel, a heel side, a toe side, a face, a rear side opposite the face, an edge portion where the crown connects with the sole, and a channel, wherein the channel is a closed loop.

Another aspect of the present invention is a golf club head comprising a crown, a sole, a hosel, a heel side, a toe side, a face, a rear side opposite the face, an edge portion where the crown connects with the sole, a first channel, and a second channel, wherein the first channel and the second channel each have portions that extend parallel to one another.

Another aspect of the present invention is a golf club head comprising a body comprising a crown, a sole, a hosel, a heel side, a toe side, a face, and a rear side opposite the face, a medallion comprising a channel, a slidable weight sized to fit within the channel, and a cover, wherein the cover is removably affixed to the medallion and traps the slidable weight within the channel. In a further embodiment, the cover may comprise a plurality of cutouts, at least one of which may be filled with a translucent material.

Yet another aspect of the present invention is a golf club head comprising a body comprising a crown, a sole, a hosel, a heel side, a toe side, a face, and a rear side opposite the face, a medallion comprising a first channel, at least one slidable weight sized to fit within the first channel, and a cover, wherein the medallion is affixed to one of the crown and the sole, and wherein the cover is removably affixed to the medallion and fixes the at least one slidable weight within the first channel. In some embodiments, the first channel may be Y-shaped or a closed loop. In other embodiments, the medallion may comprise a second channel, which may have a first part that extends parallel to the first channel and a second part that extends perpendicular to the first channel. In some embodiments, the first channel may extend across the medallion in a direction perpendicular to the face. In other embodiments, the first channel may be V-shaped.

In some embodiments, the cover may comprise an elongated cutout, and the first channel may be at least partially visible through the elongated cutout. In a further embodiment, the elongated cutout may have the same approximate shape as the channel. In another embodiment, the elongated cutout may be covered with a translucent material, such as glass or plastic. In some embodiments, the at least one slidable weight may comprise a first slidable weight and a second slidable weight. In other embodiments, each of the medallion and the cover may be composed of a non-metal material.

In some embodiments, the medallion may comprise a plurality of protrusions and the cover may comprise a plurality of cutouts sized to receive the protrusions. In a further embodiment, the protrusions may lock into the cutouts to removably secure the cover to the medallion. In another embodiment, some or all of the protrusions may comprise a textured surface. In another embodiment, the medallion may be integrally formed with one of the crown and the sole from a non-metal material. In yet another embodiment, the at least one slidable weight may comprise a polymer material, and the cover may compress the at least one slidable weight within the channel. In an alternative embodiment, the at least one slidable weight may comprise or be composed of a high-density metal material.

Yet another aspect of the present invention is a wood-type golf club head comprising a body comprising a crown, a sole, and a metal face component, a non-metal medallion comprising a Y-shaped channel and a plurality of protrusions, at least one weight sized to fit at any location within the channel, and a non-metal cover comprising an elongated first cutout having approximately the same shape as the channel, and a plurality of secondary cutouts, wherein the medallion is permanently affixed to the sole, wherein the cover is removably affixed to the medallion by locking the protrusions into the cutouts, and wherein, when the cover is affixed to the medallion, the at least one slidable weight is secured in place within the channel. In a further embodiment, the first cutout may be filled with a translucent material, which may be a plastic material.

Yet another aspect of the present invention is a golf club head comprising a crown, a sole, a hosel, a heel side, a toe side, a face, a rear side opposite the face, an edge portion where the crown connects with the sole, a first channel, and a second channel, wherein at least a portion of the first channel is perpendicular to the second channel. In a further embodiment, the first channel may intersect with the second channel at a weight port. In another embodiment, the golf club head may further comprise first and second slidable weights.

Another aspect of the present invention is a golf club head comprising a body comprising a crown, sole, and face, and an expandable weight comprising a first portion, a second portion, and a fastener, wherein at least one of the crown and the sole comprises first and second grooves that extend parallel to one another, wherein each of the first portion and second portion comprises a protrusion that extends into one of the first and second grooves.

Yet another aspect of the present invention is a golf club head comprising a body comprising a crown, a sole, a hosel, a heel side, a toe side, a face, a rear side opposite the face, an edge portion where the crown connects with the sole, and a first channel, a first slidable weight sized to fit within the first channel, the first slidable weight comprising a second channel, and a second slidable weight sized to fit within the second channel.

Another aspect of the present invention is a golf club head comprising a face component, an aft body comprising a crown, a sole, a heel side, a toe side, a crown recess, and a sole recess, a pivoting track comprising a first protrusion sized to fit within the crown recess and a second protrusion sized to fit within the sole recess, and a slidable weight engaged with the pivoting track, wherein the pivoting track is capable of moving from the heel side to the toe side.

Another aspect of the present invention is a golf club head comprising a body comprising a crown, a sole, a hosel, a heel side, a toe side, a face, a rear side opposite the face, an edge portion where the crown connects with the sole, and a deep pocket, a weight cartridge comprising an internal track, and a slidable weight sized to fit within the internal track, wherein the weight cartridge is sized to fit within the deep pocket. In some embodiments, the weight cartridge may comprise a heavy side and a lightweight side. In another embodiment, the weight cartridge may be symmetrical around a horizontal axis. In yet another embodiment, the deep pocket may be disposed in the sole.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown 12 adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the sole 14 of the driver head. Shifting weight along the channel described herein allows for control of center of gravity location.

Figure 1:
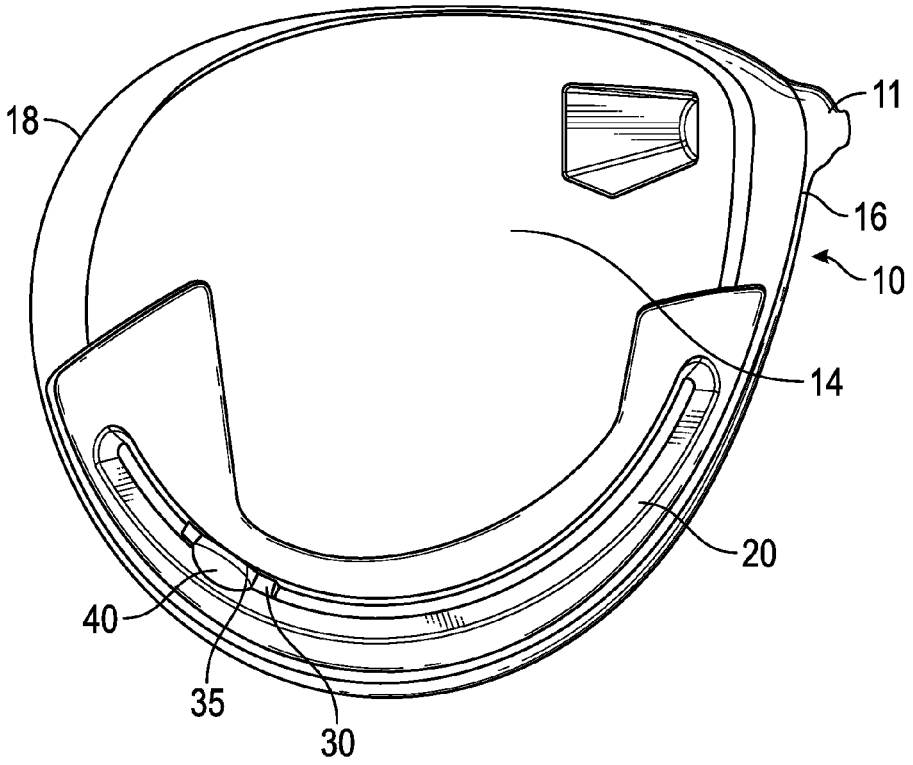
FIG. 1 is a sole plan view of a first embodiment of the present invention.

A first embodiment of the present invention is shown in FIG. 1. The golf club head 10 comprises a channel 20 disposed within the sole 14 of the golf club head, though in alternative embodiments the channel 20 may be disposed in a ribbon or skirt portion or in the crown 12 of the golf club head 10. The channel 20 extends from a heel side 16 of the club head proximate a hosel 11 to a toe side 18 of the golf club head 10 along the rear edge of the sole 14, and has a curved cross-sectional shape with an internal width W1 that is greater than an external opening width W2. A slidable cartridge 30 that is significantly smaller in length than the channel 20 is disposed within the channel 20, and is inserted into the channel 20 during construction of the golf club head so that it is permanently retained within the channel 20. The cartridge 30 includes an upper slot or opening 35 sized to receive a weight insert 40, which is customizable by a user. The weight insert 40 may be affixed to the cartridge 30 with a mechanical fastener, a semi-permanent adhesive, clip or snap mechanisms, or one or more of the mechanisms disclosed in U.S. Pat. No. 7,147,573 to DiMarco and U.S. Pat. No. 7,166,041 to Evans, the disclosure of each of which is hereby incorporated by reference in its entirety herein. In one embodiment, for example, the weight insert 40 includes a threaded portion that screws into the opening 35. A golfer may purchase a set of weight inserts 40 having different weights, densities, cosmetics, sizes, and/or shapes, which he can then use to customize the cartridge 30 and thus the golf club head 10.

Figure 2A:
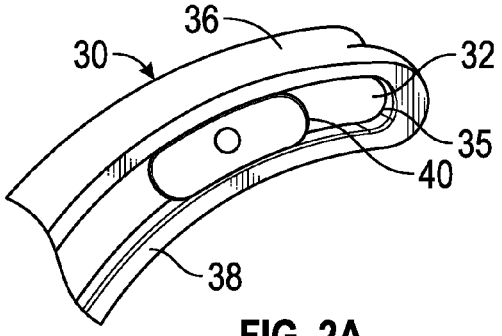
FIG. 2A is a close up view of a cartridge with a weight insert.
Figure 2B:
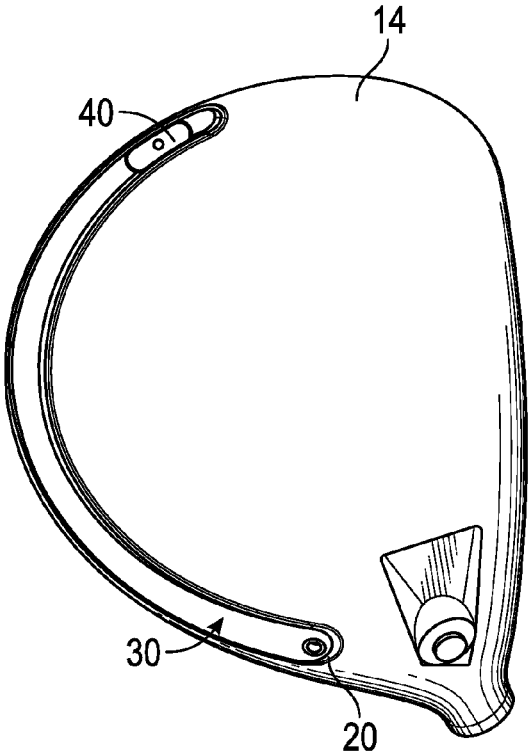
FIG. 2B is a sole plan view of a second embodiment of the present invention engaged with the cartridge and weight shown in FIG. 2A.

A second embodiment also includes a channel 20 located at approximately the same place on the sole 14 as the first embodiment, but in this embodiment the cartridge 30 is the same approximate size as the channel 20 and thus completely covers and/or fills the channel 20 when it is fully engaged with the golf club head 10, as shown in FIGS. 2A and 2B. The cartridge 30 has a hollow interior 32 accessible via an elongated opening 35 along its underside 38, which is sized to receive a slidable weight 40 that is movable to any point within the hollow interior 32 of the cartridge 30. A golfer can adjust the location of the slidable weight 40 within this embodiment by removing the cartridge 30 from the channel 20, moving the slidable weight 40 to a different location within the cartridge 30, locking the slidable weight 40 within the cartridge 30 using any means known to a person skilled in the art, and then reinserting the cartridge 30 into the channel 20. The channel 20 preferably snugly grips the exterior surfaces 36 of the cartridge 30 so that it is retained within the channel 20 with friction. In alternative embodiments, the cartridge 30 is fixed within the channel 20 with a mechanical fastener such as a screw, a semi-permanent adhesive, or one or more of the mechanisms disclosed in U.S. Pat. Nos. 7,147,573 and 7,166,041.

Figure 3:
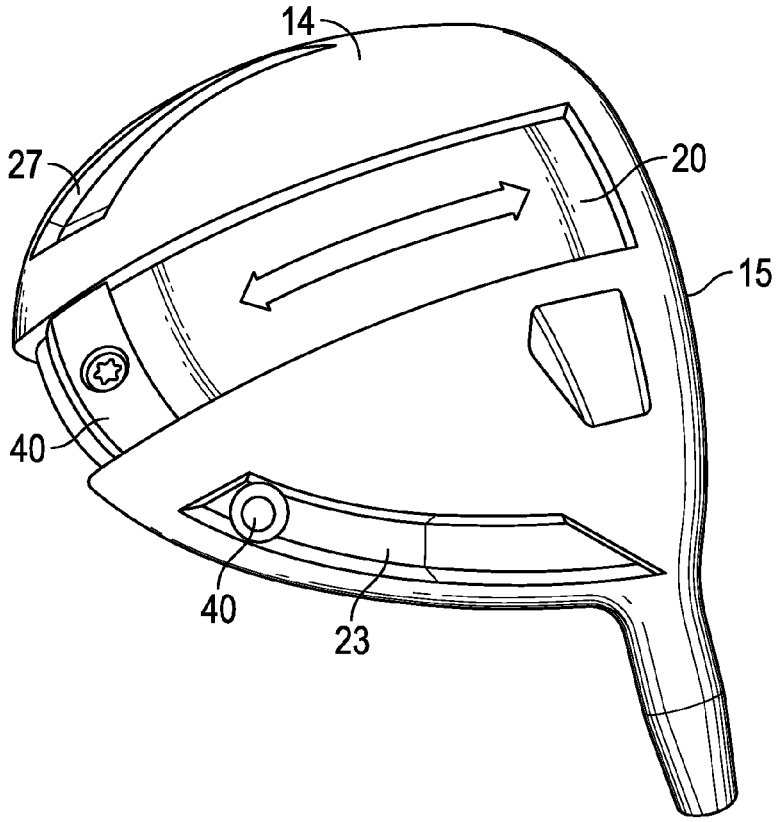
FIG. 3 is a sole perspective view of a third embodiment of the present invention.
Figure 4:
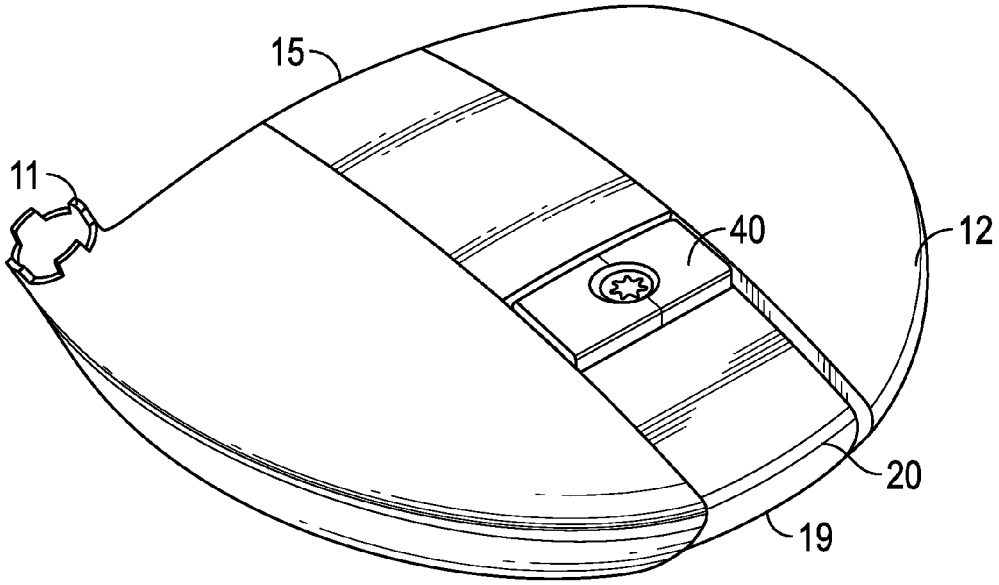
FIG. 4 is a top perspective view of the embodiment shown in FIG. 3.

A third embodiment of the present invention is shown in FIGS. 3-4. This embodiment is similar to the embodiment shown in FIGS. 28-29 of U.S. patent application Ser. No. 14/033,218, the disclosure of which is hereby incorporated by reference in its entirety herein, in that the slidable weight 40 is adjustable in a direction perpendicular to the face 15 of the golf club head 10, but in this embodiment the channel 20 extends from the sole 14 onto the crown 12 via the rear side 16 of the golf club head 10, thus permitting the slidable weight 40 to be moved from the sole 14 to the crown 12 and vice versa. This configuration allows a user to create high/low and forward/rearward center of gravity locations for the golf club head 10. This embodiment also incorporates two secondary channels 25, 27 that extend along the rear side 16 of the golf club head 10 on opposite sides of the central channel 20 so that secondary slidable weights 40 can be used to create draw and fade bias on the heel 16 and toe 18 sides.

Figure 5:
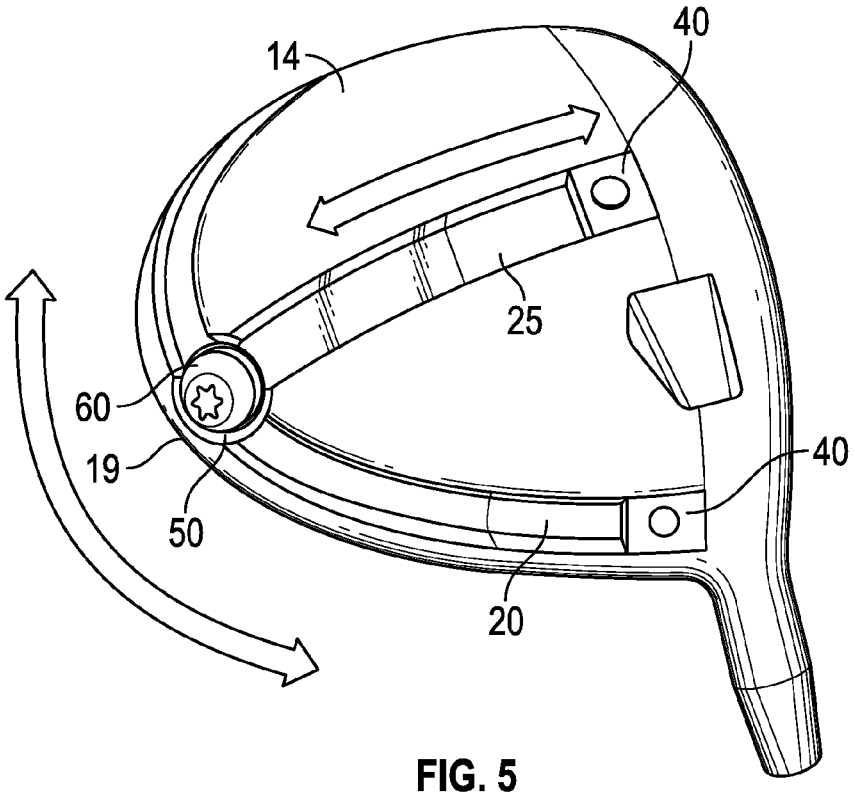
FIG. 5 is a sole perspective view of a fourth embodiment of the present invention.
Figure 6:
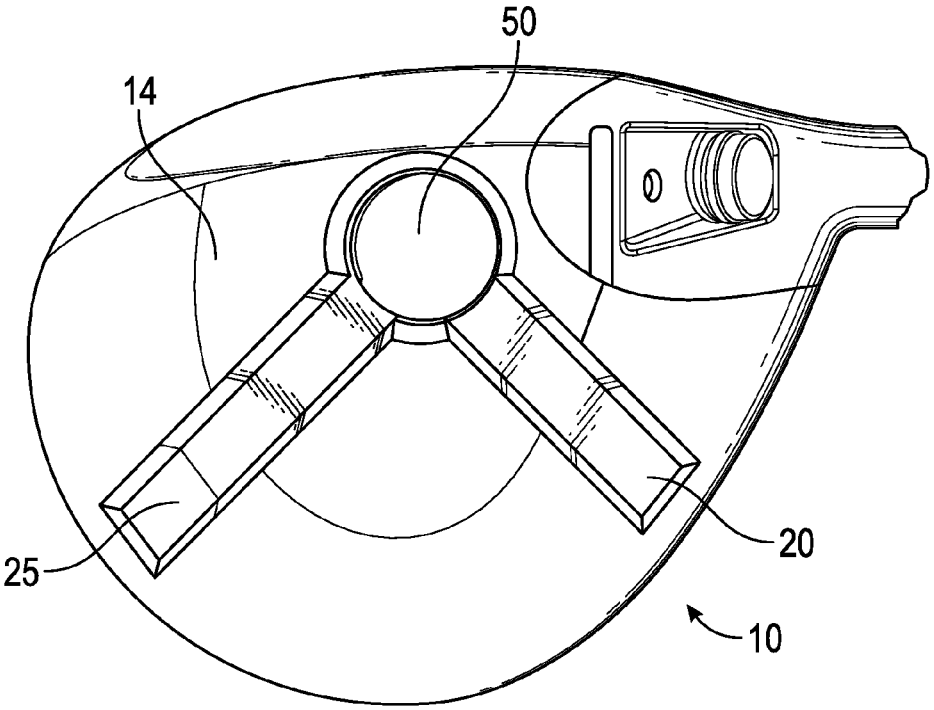
FIG. 6 is a sole plan view of a fifth embodiment of the present invention.
Figure 7:
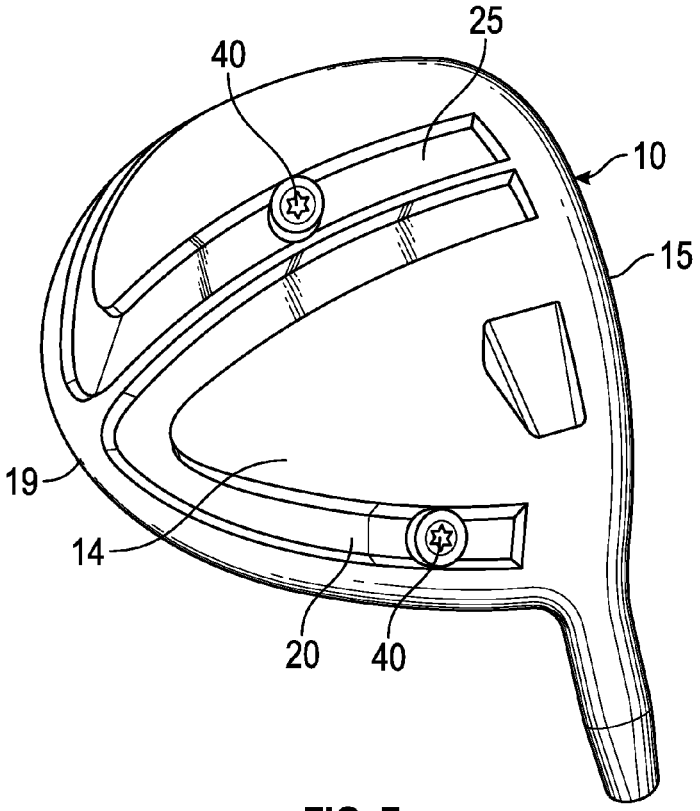
FIG. 7 is a sole perspective view of a sixth embodiment of the present invention.

In a fourth embodiment, shown in FIG. 5, the golf club head 10 comprises two channels 20, 25, one extending along the rear edge 19 of the sole 14 to allow for draw and fade bias adjustment, and one extending perpendicular to the face 15 to intersect with the channel 20 at the rear edge 19 to allow for forward/rearward center of gravity adjustment. This configuration permits the use of two or more slidable weights 40. A weight port 50 is located at the junction between the two channels 20, 25, providing an opening from which the slidable weights 40 can be removed from the channels 20, 25. The weight port 50 may be closed with a weight screw 60 or a plug as disclosed in U.S. patent application Ser. No. 14/033,218. In an alternative, fifth embodiment, the channels 20, 25 and weight port may be configured as shown in shown in FIG. 6, with an approximate V-shape. In yet another, sixth embodiment, shown in FIG. 7, each channel 20, 25 extends perpendicular to the face 15 before turning and extending in a heel 16 or toe 18 direction, such that the channels 20, 25 are parallel with one another along at least one part of the sole 14 of the golf club head 10, and approximately perpendicular to one another at another part of the sole 14. These configurations all allow for adjustments to be made to center of gravity location and bias.

Figure 8:
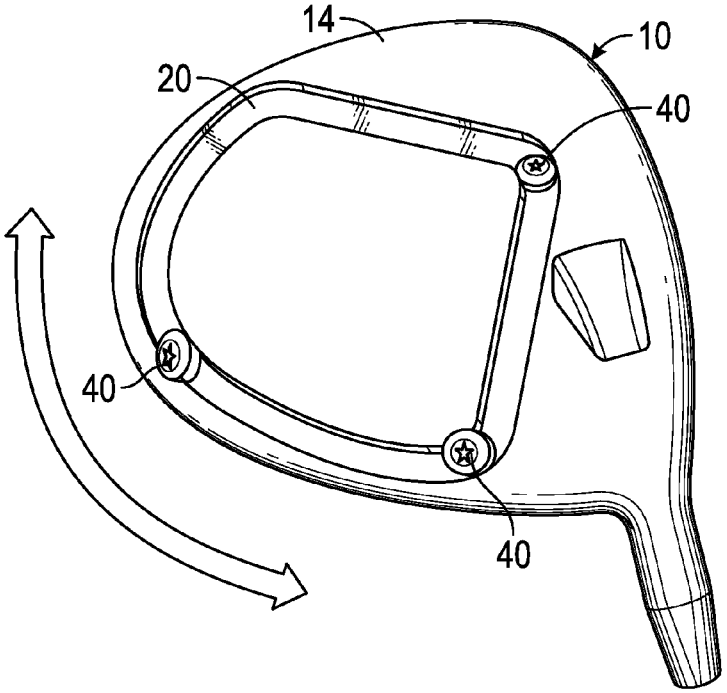
FIG. 8 is a sole perspective view of a seventh embodiment of the present invention.
Figure 9:
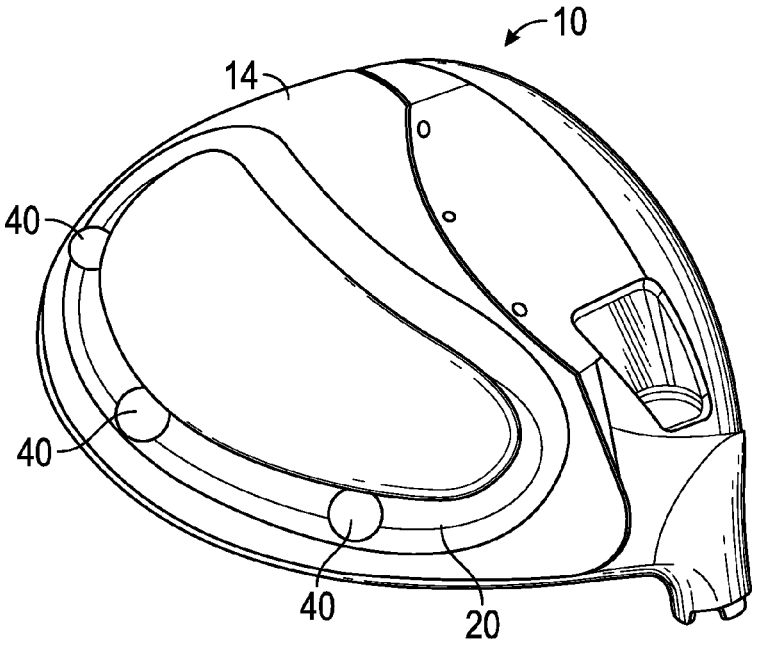
FIG. 9 is a sole perspective view of an eighth embodiment of the present invention.

In other embodiments, the channel 20 is a closed loop as shown in FIGS. 8 and 9 and is sized to receive multiple slidable weights 40, which can be used to adjust center of gravity location and bias of the golf club head 10. The closed loop can be constrained entirely to the sole 14 as shown in these Figures, or may extend onto other surfaces of the golf club head 10.

Figure 10A:
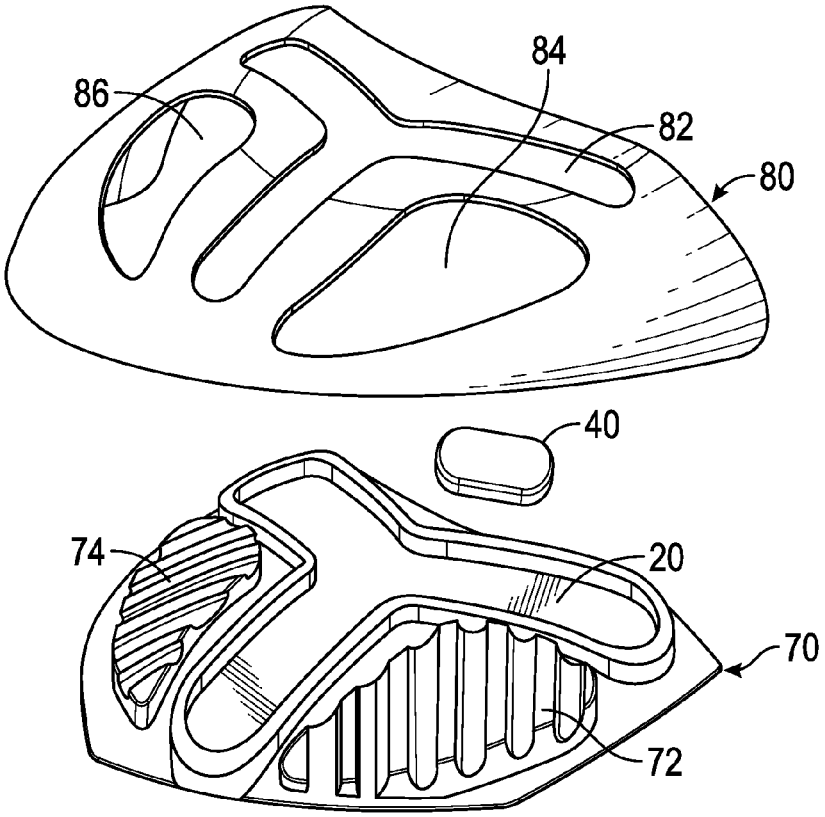
FIG. 10A is an exploded view of a weight adjustability assembly according to a ninth embodiment of the present invention.
Figure 10B:
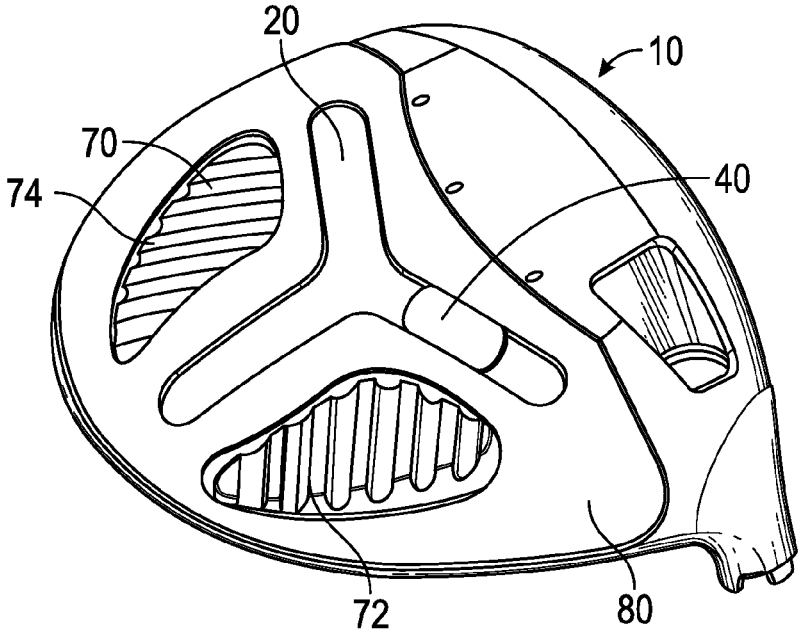
FIG. 10B is a sole perspective view of a golf club head engaged with the weight adjustability assembly shown in FIG. 10A.

In another, preferred, embodiment, shown in FIGS. 10A and 10B, any of the channels 20 disclosed herein are provided in a medallion 70 that is formed separately from the golf club head 10 and then is affixed to the sole 14 (or crown 12), though in alternative embodiments the medallion 70 may be integrally formed with the sole 14 or crown 12. The medallion preferably is composed of a lightweight, non-metal material such as composite or plastic. The slidable weight 40 is placed at a desired location within the channel 20, which in the preferred embodiment is Y-shaped, as shown in FIGS. 10A and 10B, and then a cover 80 is affixed to the medallion 70 to lock the weight 40 in place by compressing it (if it comprises a polymeric material) or otherwise trapping it within the channel 20.

The cover 80, which also is composed of a lightweight, non-metallic material, preferably includes a cutout 82 that is approximately the same shape as the channel 20 so that the location of the weight 40 within the channel 20 is visible to a user. Even more preferably, the cutout 82 is covered with a translucent material, such as plastic or a high-strength glass, so that the channel 20 and the weight 40 are visible without allowing dirt and debris to get caught in the channel 20 when the golf club head 10 is in use.

The medallion 70 also preferably includes a plurality of protrusions 72, 74, which mate with matching cutouts 84, 86 in the cover 80 and help to orient the cover 80 properly when it is applied to the medallion 70. The cover 80 may also lock onto the medallion 70 if the cutouts 84, 86 are formed such that they tightly grip the sides of the protrusions 72, 74. The protrusions 72, 74 also may have cosmetics that can be customized by the user. The medallion 70, its protrusions 72, 74, and the cover 80 may have different colors and/or textures to allow for further customization.

Figure 11:
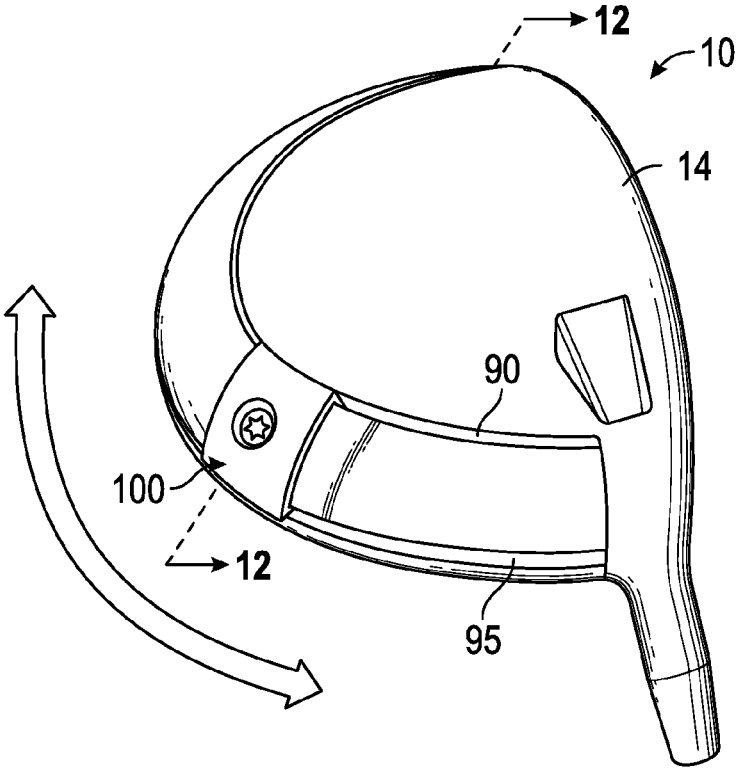
FIG. 11 is a sole perspective view of a tenth embodiment of the present invention.
Figure 12A:
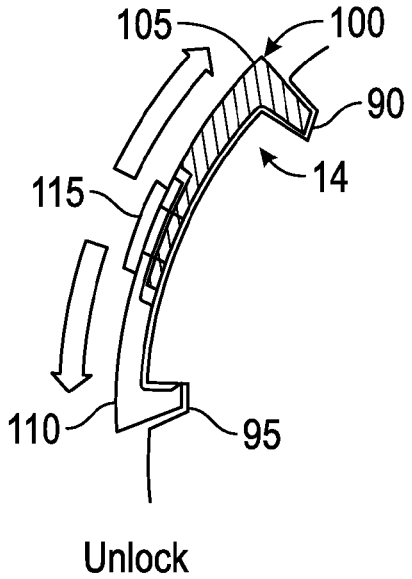
FIG. 12A is a cross-sectional view of the embodiment shown in FIG. 11 along lines 12-12 when the weight is in an unlocked configuration.
Figure 12B:
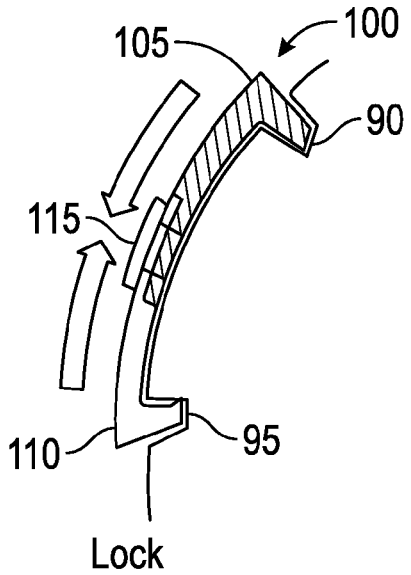
FIG. 12B is a cross-sectional view of the embodiment shown in FIG. 11 along lines 12-12 when the weight is in a locked configuration.

In an alternative embodiment, shown in FIGS. 11, 12A, and 12B, the golf club head 10 comprises two narrow grooves 90, 95 that extend parallel to one another along the rear edge 19 of the sole 14, and the slidable weight 100 is a two-piece, lockable clamp that grips the portion of the sole 14 located between the two grooves 90, 95. The slidable weight 100 in this embodiment preferably is composed of two different materials, one having a greater density (and thus overall weight) than the other, though in alternative embodiments may be composed of only one material. In the embodiment shown in FIGS. 11, 12A, and 12B, the slidable weight 100 comprises an upper, heavier portion 105 composed of a high density material such as tungsten, and a lower, lighter weight portion 110 composed of a lower density material such as aluminum, plastic, composite, or other such materials. A fastener 115 holds the upper and lower portions 105, 110 of the slidable weight 100 together. When a golfer wishes to adjust the position of the slidable weight 100 on the sole 14, she can unlock the fastener 115 and pull the two portions 105, 110 away from one another so they only loosely grip the sole 14. The golfer can then move the slidable weight 100 to a different position on the sole 14 between the two grooves 90, 95, and locks the slidable weight 100 by adjusting the fastener 115 so that the two portions 105, 110 move towards one another and tightly grip the sole 14 between the two grooves 90, 95.

Figure 13:
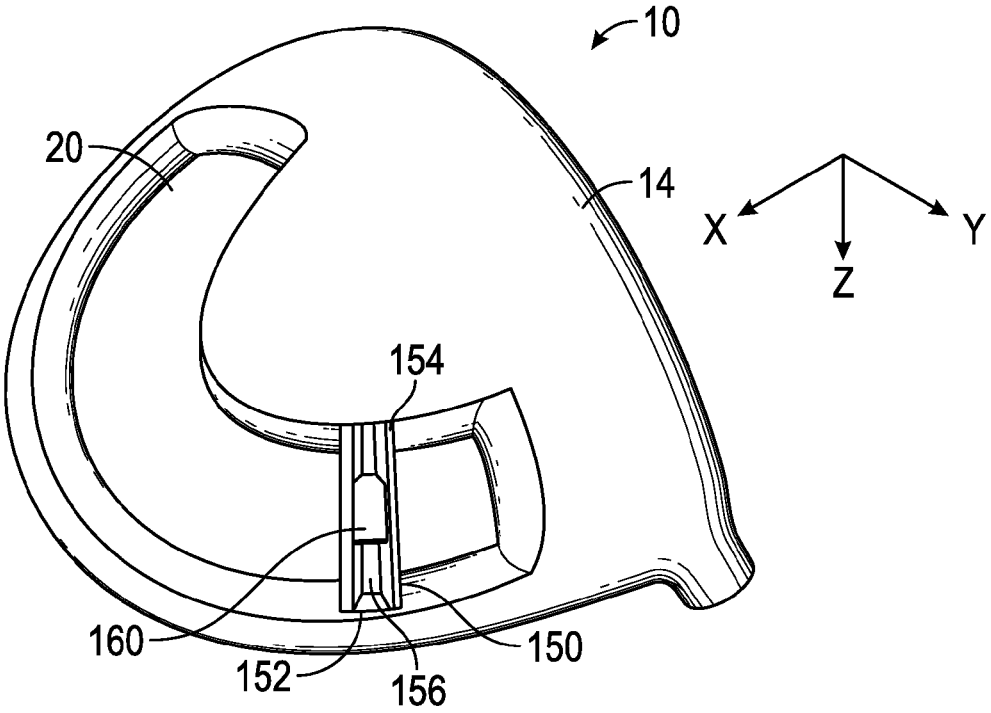
FIG. 13 is a sole perspective view of an eleventh embodiment of the present invention.

In another embodiment, shown in FIG. 13, a golf club head 10 includes a channel 20 that is sized to receive a first slidable weight 150, which itself includes a secondary slidable weight 160. In this embodiment, the first slidable weight 150 moves from heel 16 to toe 18 along the channel 20 in the sole 14, while the secondary slidable weight 160 moves from the rear edge 152 to the front-most edge 154 of the first slidable weight 150 within a channel 156 disposed in the first slidable weight 150. This configuration allows the golf club head 10 center of gravity to be moved along both the X and Y axes, while at the same time adjusting the golf club head 10 bias.

Figure 14:
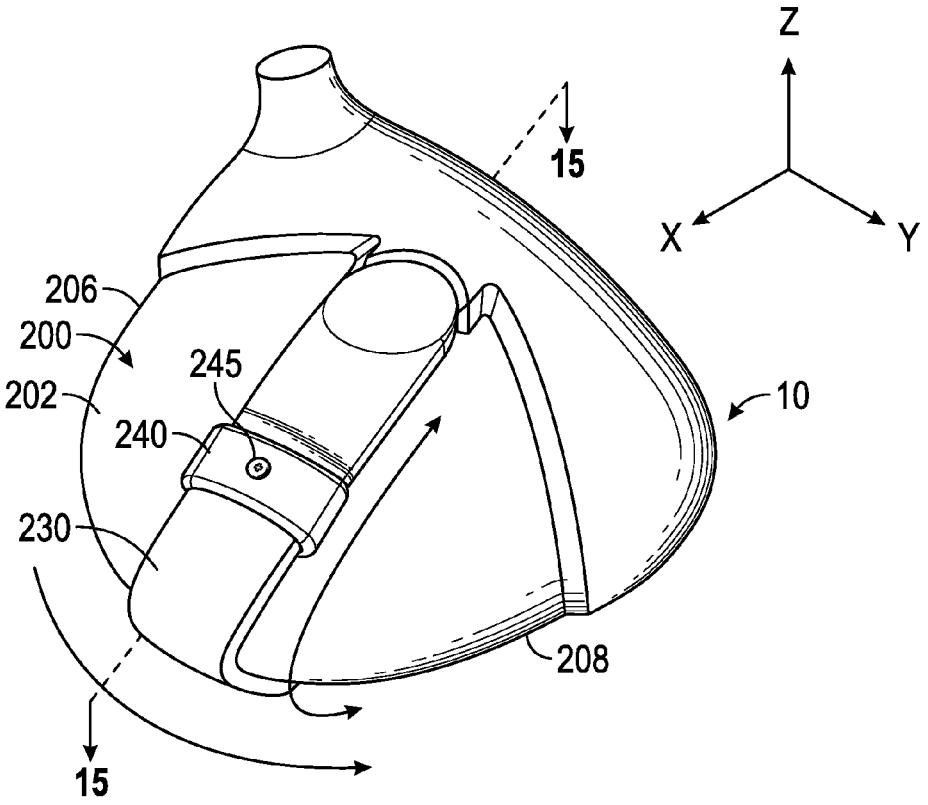
FIG. 14 is a top, rear perspective view of a twelfth embodiment of the present invention.
Figure 15:
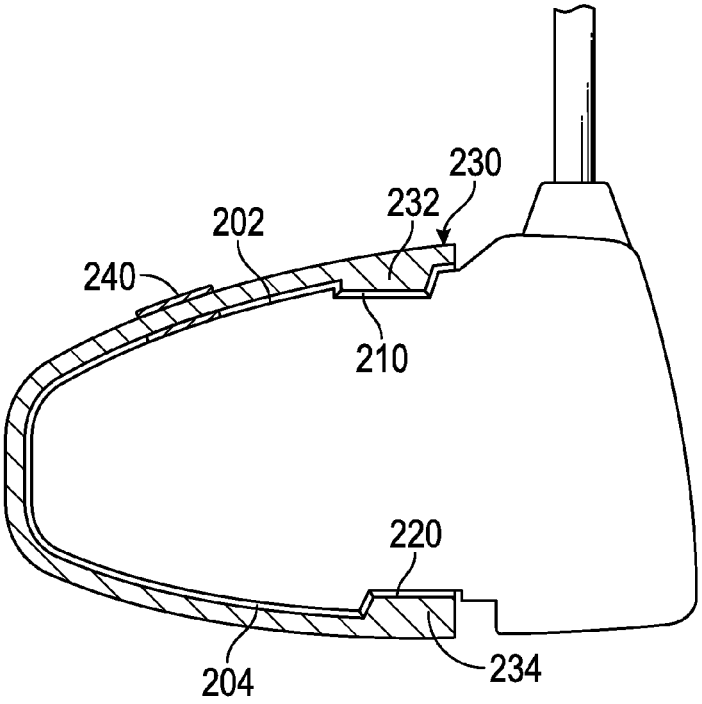
FIG. 15 is a cross-sectional view of the embodiment shown in FIG. 14 along lines 15-15.

In yet another embodiment, shown in FIGS. 14 and 15, the center of gravity of the golf club head 10 can be adjusted along all three axes. The golf club head 10 includes an aft body 200 having a crown 202, a sole 204, a crown recess 210, and a sole recess 220, a pivoting track 230 with pivot protrusions 232, 234 that fit securely within the crown and sole recesses 210, 220 and that can move from the heel side 206 to the toe side 208 of the aft body 200, and a slidable weight 240 engaged with the pivoting track 230 that can move around the aft body in a front-to-rear direction, and that can also move from the crown 202 to the sole 204. The slidable weight 240 may be engaged with the pivoting track 230 by any means known to a person skilled in the art, but in the embodiment shown in FIGS. 14-15, the slidable weight 240 encircles the pivoting track 230 and is releasably fixed to the pivoting track 230 with a fastener 245.

Figure 16:
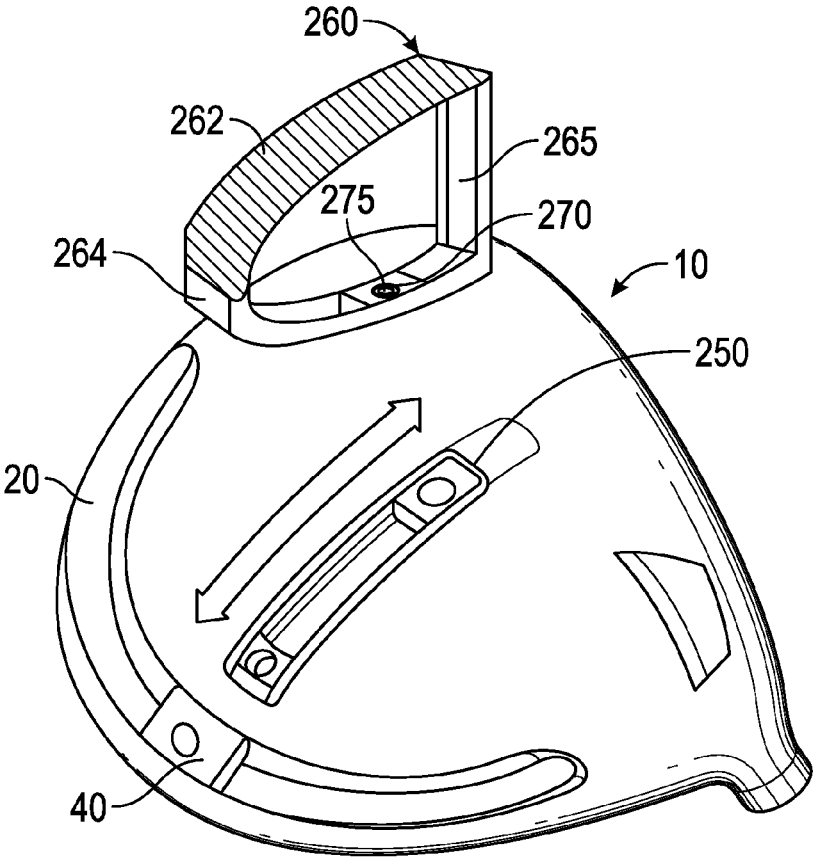
FIG. 16 is a sole plan view of a thirteenth embodiment of the present invention.
Figure 17:
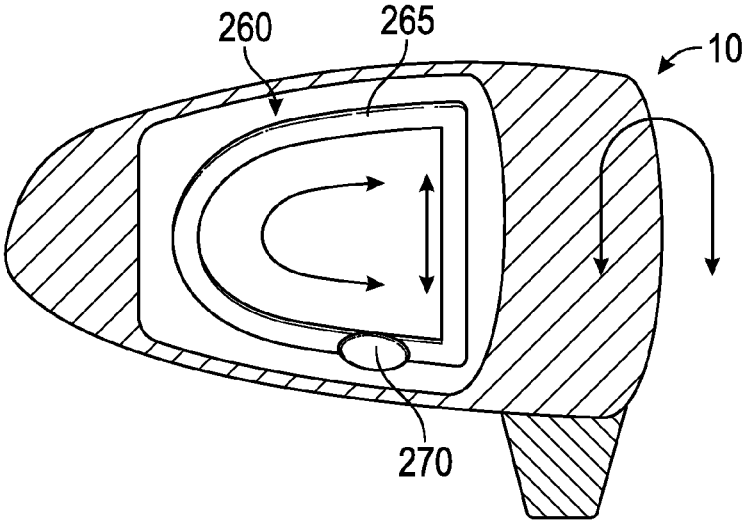
FIG. 17 is a cross-sectional view of the embodiment shown in FIG. 16 along lines 17-17.

Another embodiment is shown in FIGS. 16 and 17. In this configuration, the golf club head 10 includes a channel 20 with a slidable weight 40 as described in any of the other embodiments disclosed herein, and also includes a deep pocket 250 sized to receive a large cartridge 260 having an internal track 265 and a separate, slidable weight 270 that fits within the internal track 265 and can be affixed to any location within the internal track 265 with a fastener 275. The internal track 265 preferably extends around the entire inner surface of the cartridge 260, such that the slidable weight 270 can be moved to any location on the cartridge 260. The cartridge 260 preferably has a shape that is symmetrical around a horizontal X axis, such that the cartridge 260 can be removed from the deep pocket 250, flipped upside down, and reinserted into the deep pocket 250. This configuration allows the golf club head 10 center of gravity to be adjusted along a vertical Z axis. In some embodiments, the cartridge 260 is composed of a single material, but in a preferred embodiment, one half 262 of the cartridge 260 is composed of a high density material such as tungsten, while the other half 264 of the cartridge 260 is composed of a lighter-density material than the high density material to allow for more dramatic adjustments to the vertical center of gravity location.

The slidable weights 40 disclosed in connection with any of the embodiments shown herein may have any of the constructions disclosed in U.S. patent application Ser. No. 14/033,218, and may also be added to and removed from the golf club head 10 as disclosed in that application. Similarly, the channels 20 disclosed herein may have any of the configurations disclosed in U.S. patent application Ser. No. 13/656,271, the disclosure of which is hereby incorporated by reference in its entirety herein, and any of the channel 20 embodiments disclosed herein may disposed anywhere on a golf club head 10, including the sole, 14, crown 12, face, 15, and ribbon portions. Though each of the embodiments disclosed herein are wood-type golf club heads (drivers and fairway woods), the adjustable weighting configurations shown herein may also be used with other type of golf clubs, including irons, hybrids, and putters.

In each of the embodiments disclosed herein, the face 15 and sole 14 of the golf club head 10 preferably are formed from a metal material, while the crown 12 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims.

Therefore, the embodiments of the invention in which an exclusive property or privilege is claimed are defined in the following appended claims.

We claim:

1. A golf club head comprising:

a body comprising a crown, a sole, a hosel, a heel side, a toe side, a face, a rear side opposite the face, and at least one deep pocket extending from the crown to the sole;

a cartridge comprising an outer surface, an inner surface, and an internal track extending along at least a portion of the inner surface; and a first slidable weight, wherein the at least one deep pocket comprises an opening, wherein the cartridge is sized to fit through the opening and within the at least one deep pocket, and wherein the first slidable weight is disposed within and reversibly fixed to at least one of a plurality of points within the internal track.

2. The golf club head of claim 1, wherein the cartridge is symmetrical around a horizontal x-axis extending in a face-to-rear side direction.

3. The golf club head of claim 1, wherein the inner surface comprises a closed loop, and wherein the internal track extends along the entire closed loop.

4. The golf club head of claim 1, wherein the cartridge comprises an upper portion composed of a first material having a first density and a lower portion composed of a second material having a second density, and wherein the first density is greater than the second density.

5. The golf club head of claim 4, wherein the first material is tungsten.

6. The golf club head of claim 1, wherein the opening is disposed in the sole.

7. The golf club head of claim 1, wherein the golf club head is a wood-type golf club head, wherein the face and the sole are composed of a metal material, and wherein the crown is composed of a non-metal material.

8. The golf club head of claim 7, wherein the metal material is a titanium alloy, and wherein the non-metal material is a composite.

9. The golf club head of claim 1, wherein the cartridge is reversibly fixed within the at least one deep pocket with a mechanical fastener.

10. The golf club head of claim 1, wherein the opening extends in a face-to-rear side direction.

11. The golf club head of claim 1, further comprising a second slidable weight and a channel extending from the heel side to the toe side along the rear side of the body, and wherein the second slidable weight is disposed within the channel.

12. The golf club head of claim 11, wherein the channel is disposed in the sole.

13. The golf club head of claim 1, wherein the golf club head is a driver-type golf club head.

14. The golf club head of claim 13, wherein the sole comprises a composite material.

15. A driver-type golf club head comprising:

a metal body comprising a sole, a hosel, a heel side, a toe side, a face, a rear side opposite the face, and a deep pocket extending into the sole, the deep pocket comprising an opening extending in a face-to-rear side direction;

a composite crown;

a cartridge comprising an outer surface, an inner surface, and an internal track extending along at least a portion of the inner surface; and a first slidable weight, wherein the cartridge is sized to fit through the opening and within the deep pocket, wherein the cartridge comprises at least one high density material and at least one low-density material, wherein the inner surface comprises a closed loop, wherein the internal track extends along the entire closed loop, and wherein the first slidable weight is disposed within and reversibly fixed to at least one of a plurality of points within the internal track.

16. The driver-type golf club head of claim 15, wherein the cartridge is symmetrical around a horizontal x-axis extending in a face-to-rear side direction, and wherein the at least one high density material comprises a tungsten material.

17. The driver-type golf club head of claim 15, further comprising a sole channel, wherein the sole channel encircles the deep pocket.

* * * * *